US005762009A

United States Patent [19]

Garrison et al.

[11] Patent Number: 5,762,009

[45] Date of Patent: Jun. 9, 1998

[54] PLASMA ENERGY RECYCLE AND CONVERSION (PERC) REACTOR AND PROCESS

[75] Inventors: Millard M. Garrison, Edina, Minn.; John S. Vavruska, Santa Fe, N. Mex.

[73] Assignees: Alliant Techsystems, Inc., Hopkins, Minn.; Plasma Technology, Inc., Santa Fe, N. Mex.

[21] Appl. No.: 484,667

[22] Filed: Jun. 7, 1995

[51] Int. Cl.[6] ..... F23G 7/00

[52] U.S. Cl. ..... 110/346; 110/250; 110/237; 219/121.38

[58] Field of Search ..... 110/237, 346, 110/250; 219/121.36, 121.37, 121.38, 121.4

[56] References Cited

U.S. PATENT DOCUMENTS

| | | |
|---|---|---|
| 3,051,639 | 8/1962 | Anderson . |
| 3,257,196 | 6/1966 | Foex . |
| 3,332,870 | 7/1967 | Orbach et al. . |
| 3,891,562 | 6/1975 | Mogensen et al. . |
| 3,918,374 | 11/1975 | Yamamoto et al. . |
| 4,326,842 | 4/1982 | Adachi et al. . |
| 4,341,915 | 7/1982 | Adachi et al. . |
| 4,390,772 | 6/1983 | Hiratake . |
| 4,431,901 | 2/1984 | Hull . |
| 4,432,942 | 2/1984 | Adachi et al. . |
| 4,438,706 | 3/1984 | Boday et al. . |
| 4,479,443 | 10/1984 | Faldt et al. . |
| 4,508,040 | 4/1985 | Santen et al. . |
| 4,610,857 | 9/1986 | Ogawa et al. . |
| 4,615,285 | 10/1986 | Bentell et al. . |
| 4,631,384 | 12/1986 | Cornu . |
| 4,635,573 | 1/1987 | Saten . |
| 4,644,877 | 2/1987 | Barton et al. . |
| 4,727,236 | 2/1988 | Hull et al. . |
| 4,766,351 | 8/1988 | Hull et al. . |
| 4,770,109 | 9/1988 | Schlienger . |
| 4,801,435 | 1/1989 | Tylko . |
| 4,802,919 | 2/1989 | Fey . |
| 4,823,711 | 4/1989 | Kroneberger et al. . |
| 4,831,944 | 5/1989 | Durand et al. . |
| 4,883,570 | 11/1989 | Efthimion et al. . |
| 4,886,001 | 12/1989 | Chang et al. . |
| 4,896,614 | 1/1990 | Kulkarni . |
| 4,909,164 | 3/1990 | Shohet et al. . |
| 4,909,914 | 3/1990 | Chiba et al. . |
| 4,912,296 | 3/1990 | Schlienger . |
| 4,919,190 | 4/1990 | Newman et al. . |

(List continued on next page.)

FOREIGN PATENT DOCUMENTS

| | | |
|---|---|---|
| 2201720 | 1/1972 | European Pat. Off. . |
| 0290974 | 11/1988 | European Pat. Off. . |
| 0391748 | 10/1990 | European Pat. Off. . |
| 0426926 | 5/1991 | European Pat. Off. . |
| 289402 | 12/1989 | Germany . |
| 4042028 | 12/1990 | Germany . |
| 6211320 | 3/1978 | Japan . |
| 4279179 | 2/1991 | Japan . |
| 4341792 | 5/1991 | Japan . |
| 2113815 | 7/1982 | United Kingdom . |
| 2152949 | 6/1984 | United Kingdom . |

OTHER PUBLICATIONS

PCT WO 82/00509 Jul. 10, 1981.

PCT WO 91/11658 Jan. 16, 1991.

"EPA to Evaluate New Technologies for Cleaning Up Hazardous Waste", May 25,1987, C & En—Magazine Article.

*Primary Examiner*—Henry A. Bennett
*Assistant Examiner*—Susanne C. Tinker
*Attorney, Agent, or Firm*—Hugh D. Jaeger

[57] ABSTRACT

Plasma energy recycle and conversion (PERC) reactor and process for disposal of energetics such as solid rocket propellants, liquid rocket fuel, chemical agents such as nerve gas, industrial waste such as paint sludge, medical waste or any aqueous/organic liquid or slurry that is pumpable and for separation/consolidation/conversion of low-level radioactive waste or mixed waste incorporating an induction coupled plasma heat source, insulated primary and secondary reaction chambers and associated peripheral control, process and filter devices.

9 Claims, 6 Drawing Sheets

U.S. PATENT DOCUMENTS 4,960,380 10/1990 Cheetham .
4,980,092 12/1990 Pineau et al. .
5,026,464 6/1991 Mizuno et al. .
5,065,680 11/1991 Cheetham .
5,090,340 2/1992 Burgess .
5,095,828 3/1992 Holden et al. .
5,108,718 4/1992 Dummersdorf et al. .
5,123,362 6/1992 Kikuchi .
5,134,946 8/1992 Poovey .
5,138,959 8/1992 Kulkarni .
5,200,595 4/1993 Boulos et al. .
5,204,506 4/1993 Asmus et al. .
5,206,879 4/1993 Moody et al. .
5,244,488 9/1993 Sato et al. .
5,256,854 10/1993 Bromberg et al. .
5,270,515 12/1993 Long .
5,276,297 1/1994 Nara .
5,288,969 2/1994 Wong et al. .
5,301,620 4/1994 Nagel et al. .
5,310,411 5/1994 Tognazzo .

PLASMA ENERGY RECYCLE AND CONVERSION (PERC) REACTOR AND PROCESS

CROSS REFERENCES TO CO-PENDING APPLICATIONS

None.

BACKGROUND OF THE INVENTION

1. Field of the Invention

The present invention is a plasma energy recycle and conversion (PERC) reactor, and more particularly pertains to a plasma energy recycle and conversion reactor and associated system for conversion of waste materials.

2. Description of the Prior Art

Prior art reactor devices often incorporate heat sources of low thermal output or devices having heat sources such as carbon arcs, resistance heaters and the like. Often these devices proved to be tricky or difficult to control due to the high local operating temperature which would often cause component usage or breakdown.

Clearly what is needed is a PERC reactor system including a dependable and controllable high power heat source which also includes no expendable components. Also what is needed is a reaction chamber that maximizes high destruction and conversion efficiencies through good mixing using a combination of a stirred tank reactor followed by a plug flow reactor.

SUMMARY OF THE INVENTION

The general purpose of the present invention is a plasma energy recycle and conversion (PERC) reactor and process including various control and process devices.

According to one embodiment of the present invention, there is provided a PERC reactor including a plasma torch heated primary reactor coupled to a secondary reactor. Argon gas or other suitable gas is converted into a plasma jet by an induction coupled plasma torch at one end of the primary reactor. Waste products are prepared into a liquid, gas or slurry form, and are introduced into a primary reaction chamber in the primary reactor through an atomizing spray nozzle which uses pressurized argon, steam or any other gas depending upon the material to atomize the gas, slurry or liquid waste material. The intense heat of the plasma jet converts the various forms of waste material into a gas which is drawn through one or more flow restrictions or venturies and chambers in the primary reactor and into a second chamber to complete chemical conversion or destruction of the reactants. The waste gas is then routed through a heat exchanger, a filter and an absorber tower and drawn through a combustion chamber where the gas can be oxidized. Various controls, monitors, pressure gauges and the like are incorporated to control and monitor the reaction process. The output is later described in detail as harmless gas and harmless ash.

According to one embodiment of the present invention, there is provided a primary (PERC) reactor. An induction coupled plasma (ICP) torch on an induction coupled plasma torch assembly aligns at the top of the primary reactor and includes an input for argon gas which is heated by induction to form a plasma jet in the interior of the reaction chamber which aligns beneath the induction coupled plasma torch. The torch can be started with argon or any other suitable gas such as nitrogen, oxygen, or even steam. Various layers of insulative materials surround a cylindrical high temperature hot face refractory which lines this reaction chamber. A plurality of access or sensing ports, including an argon and slurry entry port, an off-gas port, a pressure transmitter and pressure relief port, a thermocouple port and a sight port align through the various insulative materials and through the high temperature refractory. A ramped insert forms the bottom of the primary reactor.

The plasma energy recycle and conversion (PERC) reactor and process is for disposal of energetics such as solid rocket propellants, liquid rocket fuel, chemical agents such as nerve gas, industrial waste such as paint sludge, medical waste or any aqueous/organic liquid or slurry that is pumpable and for separation/consolidation/conversion of low-level radioactive waste or mixed waste incorporating an induction coupled plasma heat source, insulated primary and secondary reaction chambers and associated peripheral control, process and filter devices.

An atomizing nozzle is for introduction of waste slurry, liquid or gas into a flow restriction orifice throat.

In the PERC process for waste treatment, it is beneficial to take advantage of any "plasma chemical effects" by use of induction plasma. The induction plasma as a high temperature gas heat source delivers high enthalpy into a small volumetric flowrate of gas followed by heat transfer to the waste feed stream. From a chemical process standpoint, the formation of a plasma can be thought of as a "side effect" or consequence of using induction to transfer electric power into a flowing gas stream. Thus a plasma is not required to carry out the chemical reactions but a plasma must be created in order to have a conductor (the gas serving as an "electrode") to transfer the power into the gas. In fact, contacting of a waste stream with the plasma such that the waste constituents are heated to near plasma temperature is not necessary for adequate waste destruction. Heating waste to near plasma temperature is also undesirable from the standpoint of specific energy consumption in kw-h/lb of waste processed. Given that a plasma is produced, there are radiative ("T") and convective heat losses associated with sustaining a plasma at >6,000° C. in close proximity to a cold wall. The plasma forms inside the induction coil zone because this is the only region where a sufficiently strong oscillating magnetic field exists to sustain the plasma.

The specific chemical flowsheet dictates the optimum plasma gas for reaction compatibility or to serve as a reactant. For steam reforming, steam would appear to be the optimum plasma gas. Argon, an inert gas, should be compatible with any chemical flowsheet and is the easiest gas to ionize, but is costly, and reduces the power efficiency because of its high plasma temperature.

The most appropriate chemical flowsheet for a given waste treatment application must be evaluated for each particular waste stream. Steam reforming is not the optimum flowsheet in all situations. Identified alternatives include oxidation, direct thermal decomposition (cracking), and reactions with other reagents. The off-gas processing is assessed in conjunction with selection of any chemical flowsheet.

The process of feed introduction into the reactor is of prime importance. For liquids and slurries, fine atomization is the one approach. Reliable feed preparation procedures, thermally stable slurries, and possible cooling of the feed as it enters the reactor are all important processes.

The location of feed introduction with respect to the plasma heat source effects final gas product quality. For hydrocarbon feed materials, intimate mixing with a non-steam plasma may result in cracking of the hydrocarbon to form carbon soot which is characterized by low conversion kinetics because this is a gas/solid reaction (mass transfer limited). The net result is that the reactor design gas residence time may not be sufficient to convert the carbon to carbon monoxide. In such situations, soot removal downstream would be required. Adequate steam concentration in the high temperature zone would help avoid soot formation.

High initial turbulence for good mixing and mass and heat transfer in the primary reaction chamber can be one approach. The variables of turbulence are gas flowrate, reaction chamber size (volume), and feed introduction method and location.

Total gas flowrate through the reactor can be increased by increasing the plasma gas flowrate, introducing a separate gas stream, increasing the feed atomization medium flowrate, and recycling off-gas back to the primary reaction chamber. Increasing the gas flowrate reduces the average gas residence time in both the primary and secondary reaction chamber. It also increases the heat load on the plasma and increases the specific energy requirement (SER) in kw-h/lb of waste processed, also increasing operating costs.

Reducing the primary reaction chamber volume at a given total gas flowrate also increases turbulence. The volume can only be reduced so much. The diameter must be somewhat larger than the plasma torch gas exit diameter. If the primary reaction chamber refractory inside wall is too close to the plasma flame, melting of the refractory may become a concern.

The process and location of atomized feed introduction should effect turbulence to some extent. For example, the feed can be introduced (a) radially across the reactor centerline, (b) axially, i.e., down the length of the primary reaction chamber either cocurrent or countercurrent with the plasma gas, and (c) tangentially to create a swirl pattern. The operational impacts of any of these approaches include impingement of feed on refractory and subsequent refractory spalling, and the effect on torch operation to the point of torch surface fouling and even extinguishment. In small reaction chamber volumes impingement of feed on refractory cannot be avoided but use of appropriate refractory will protect the reaction chamber walls.

The current primary reaction chamber functions as an ideal continuous stirred tank reactor (CSTR), a term familiar to chemical engineers. The degree of backmixing in the primary reaction chamber should be high which relates to initial turbulence. One process of enhancing backmixing is to provide a restriction or "choke" between the primary and secondary reaction chamber. The degree of backmixing will be higher for a sharp-edged orifice than for a smooth transition from the primary reaction chamber into the restriction.

The PERC process is based on the primary reaction chamber being a CSTR and the secondary reaction chamber being a plug flow reactor (PFR). The process is that reactants should be well mixed in the primary reaction chamber and a guaranteed constant residence time should be achieved for all reactants in the PFR secondary reaction chamber. PFR's are characterized by a very narrow (approaching uniform) residence time distribution. The higher the length-to-diameter (L/D) ratio for the secondary reaction chamber, the more uniform the residence time distribution. The secondary reaction chamber can have an L/D ratio of 5 to 50.

One significant aspect and feature of the present invention is a plasma energy recycle and conversion reactor.

Another significant aspect and feature of the present invention is the incorporation of a primary plasma energy recycle and conversion (PERC) reactor.

Still another significant aspect and feature of the present invention is the incorporation of a plug flow secondary plasma energy recycle and conversion reactor.

An additional significant aspect and feature of the present invention is an induction-coupled plasma torch to create a plasma jet.

A still additional significant aspect and feature of the present invention is the use of argon to create a plasma jet.

A further significant aspect and feature of the present invention is a plasma jet used for waste conversion to a gas.

A still further significant aspect and feature of the present invention is that no moving or expendable components are used in the reactors.

A yet further significant aspect and feature of the present invention is the ability to convert energetic compounds containing significant quantities of fuel bound nitrogen to useful fuel gas while minimizing the production of nitrogen oxide $NO_x$ compounds such as $NO_2$ and NO.

Yet another further significant aspect and feature of the present invention is the use of dry superheated or saturated steam to atomize or otherwise mix slurred waste, liquid waste or gaseous materials for conversion in a reactor.

Having thus described embodiments of the present invention, it is the principal object of the present invention to provide a plasma energy recycle and conversion (PERC) reactor and process.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
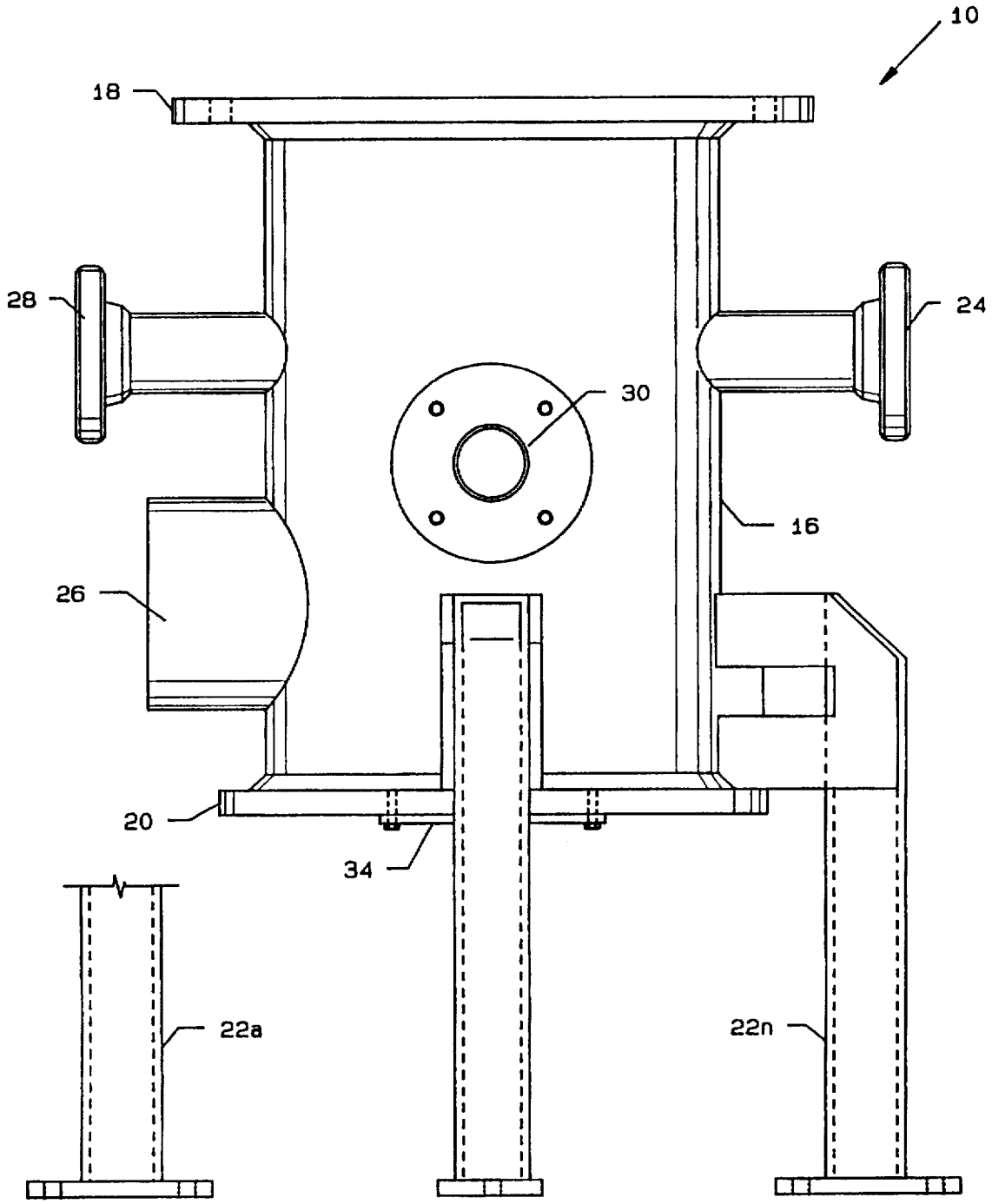
FIG. 1 illustrates a front view of the primary PERC reactor.
Figure 2:
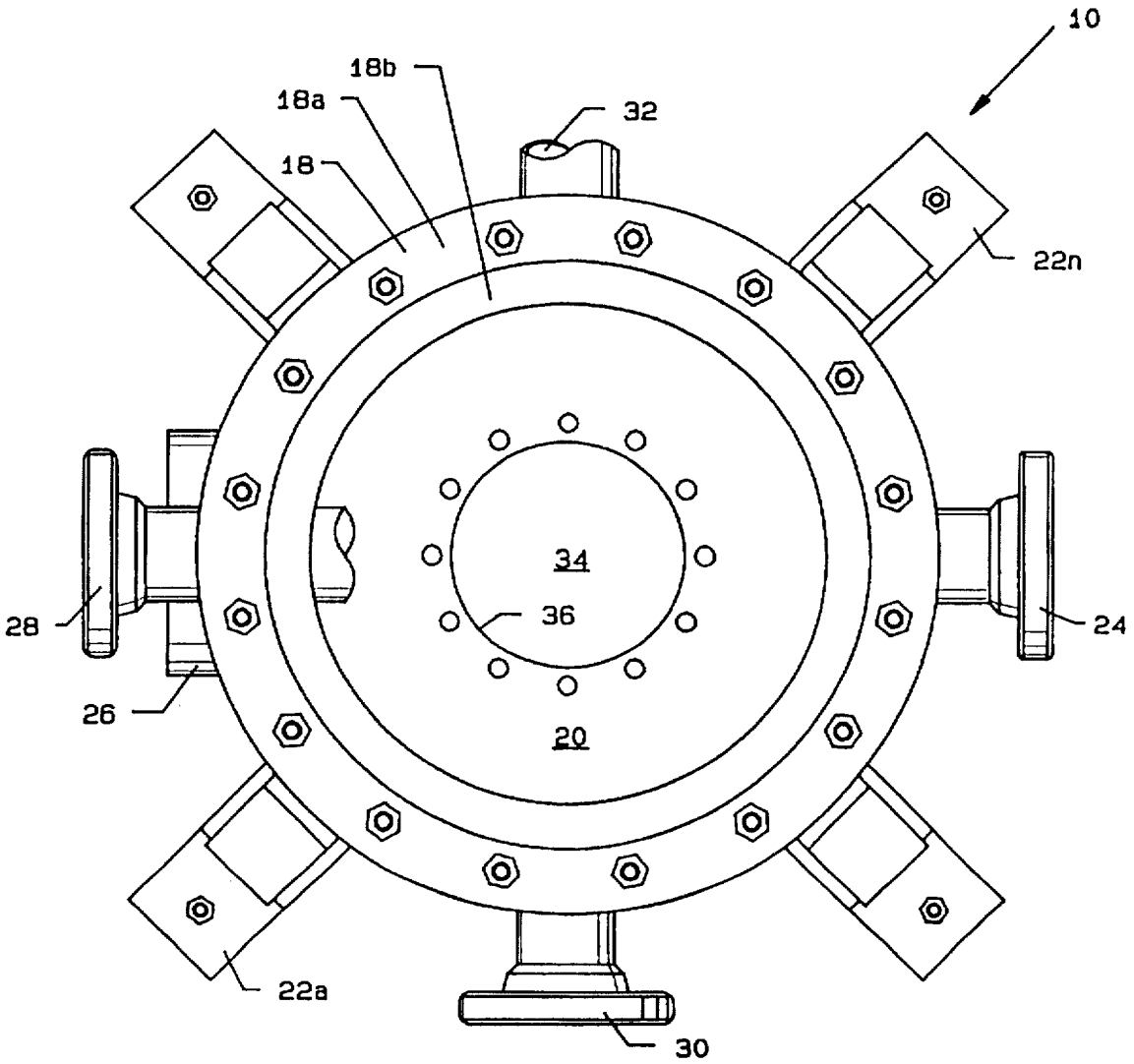
FIG. 2 illustrates a top view of the primary PERC reactor.
Figure 3:
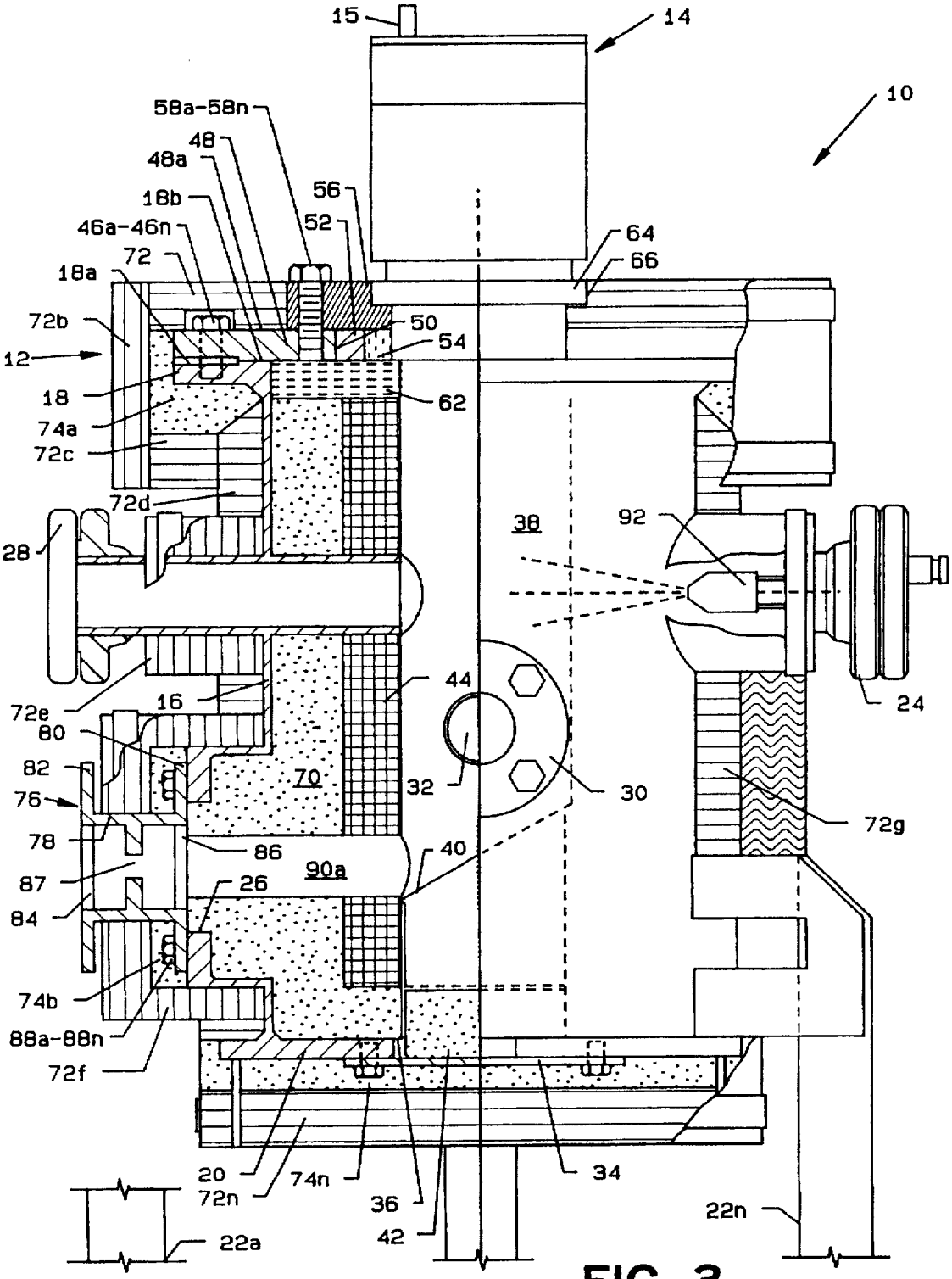
FIG. 3 illustrates a side view in partial cross-section of the primary PERC reactor including insulation members and a plasma torch and plasma torch assembly.

FIGS. 1, 2 and 3 illustrate a primary plasma energy recycle and conversion (PERC) reactor, also known as a PERC reactor 10 which is now described. FIGS. 1 and 2 illustrate the primary PERC reactor 10 without the external or internal insulation layers and without the induction coupled plasma torch top assembly 12 and induction coupled plasma torch 14 illustrated in FIG. 3. U.S. Pat. No. 4,431,901 is a representative induction coupled plasma torch. Central to the primary PERC reactor 10 is a cylindrical steel housing 16 having an upper horizontally aligned annular flange 18 with flange surfaces **18*a* and 18*b* and a lower horizontally aligned annular flange 20. A plurality of support legs 22*a*–22*n* are illustrated as rotated into view in FIGS. 1 and 3 which align around and about the housing 16**. Access ports in the form of flanged tubes align in radial fashion around and about the circumference of the housing 16 at various levels including an argon and slurry entry port 24, an off-gas port 26, a combination pressure transmitter and pressure relief port 28, a thermocouple port 30 and a sighting port 32. A circular plate 34 suitably secures, such as by machine screws, over and about the lower annular flange 20. Orifice 36 provides access at the lower region of a centrally located cylindrically shaped primary reactor chamber 38. A ramped reactor chamber bottom member insert 40 and a castable insulation member 42 align in the lower region of the primary reactor chamber 38 and are held therein by the circular plate 34. The cylindrical side of the primary reactor chamber 38 is lined with phosphate-bonded chromium-aluminum oxide high temperature hot face refractory 44.

The primary plasma torch top assembly 12 and its associated members are now described. The primary plasma torch top assembly 12 secures to the upper annular flange 18 by a plurality of machine bolts 46*a*–46*n*. The top assembly 12 includes a heavy circular plate 48 having a large orifice 50 centrally located. A ceramic ring 52 aligns in the large orifice 50 and a fiber board insulation ring 54 aligns central to the ceramic ring 52. A large ceramic mounting ring 56 secures to the top surface 48*a* of the heavy circular plate 48 and over the ceramic ring 52 and the fiber board insulation ring 54 by a plurality of machine bolts 58*a*–58*n*. The plasma torch 14, including an input 15 and a mounting flange 64, suitably secures central to an annular recess 66 in the ceramic torch mounting ring 56. Hot face refractory 44 extends to the upper portion of the primary reactor chamber 38 and is aligned and secured below the alumina-silica ceramic fiber insulation 62 which is located just below the lower surface of the circular plate 48, the large orifice 50, the ceramic ring 52, and the fiber board insulation ring 54.

Insulating castable refractory 70 is located between the inner surfaces of the housing 16 and the hot face refractory 44 as well as other portions of the primary plasma torch top assembly 12.

Various other insulative mineral fiberboard thermal insulation members 72*a*–72*n* and other insulative castable refractory materials 74*a*–74*n* surround the housing 16 and various port members to maintain internally generated heat within the primary reactor chamber 38.

The off-gas port 26 accommodates a gas mixing orifice 76 resembling a spool. The gas mixing orifice 76 includes a cylindrical body 78, inner and outer flanges 80 and 82, outer and inner orifices 84 and 86 and a central orifice restriction 87. The gas mixing orifice 76 aligns and secures with machine bolts 88*a*–88*n* to the off-gas port 26 and is in alignment with a passage 90 extending through the insulating castable refractory 70 and the hot face refractory 44 to the interior of the primary reactor chamber 38.

Argon and waste slurry are introduced through the argon and slurry feed port 24 and down into the primary reactor chamber 38 by a two-fluid atomizing spray nozzle 92.

Figure 4:
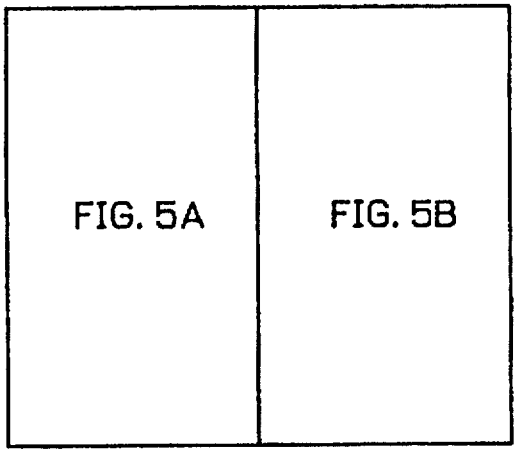
FIG. 4 illustrates the alignment of FIGS. 5A and 5B.
Figure 5A:
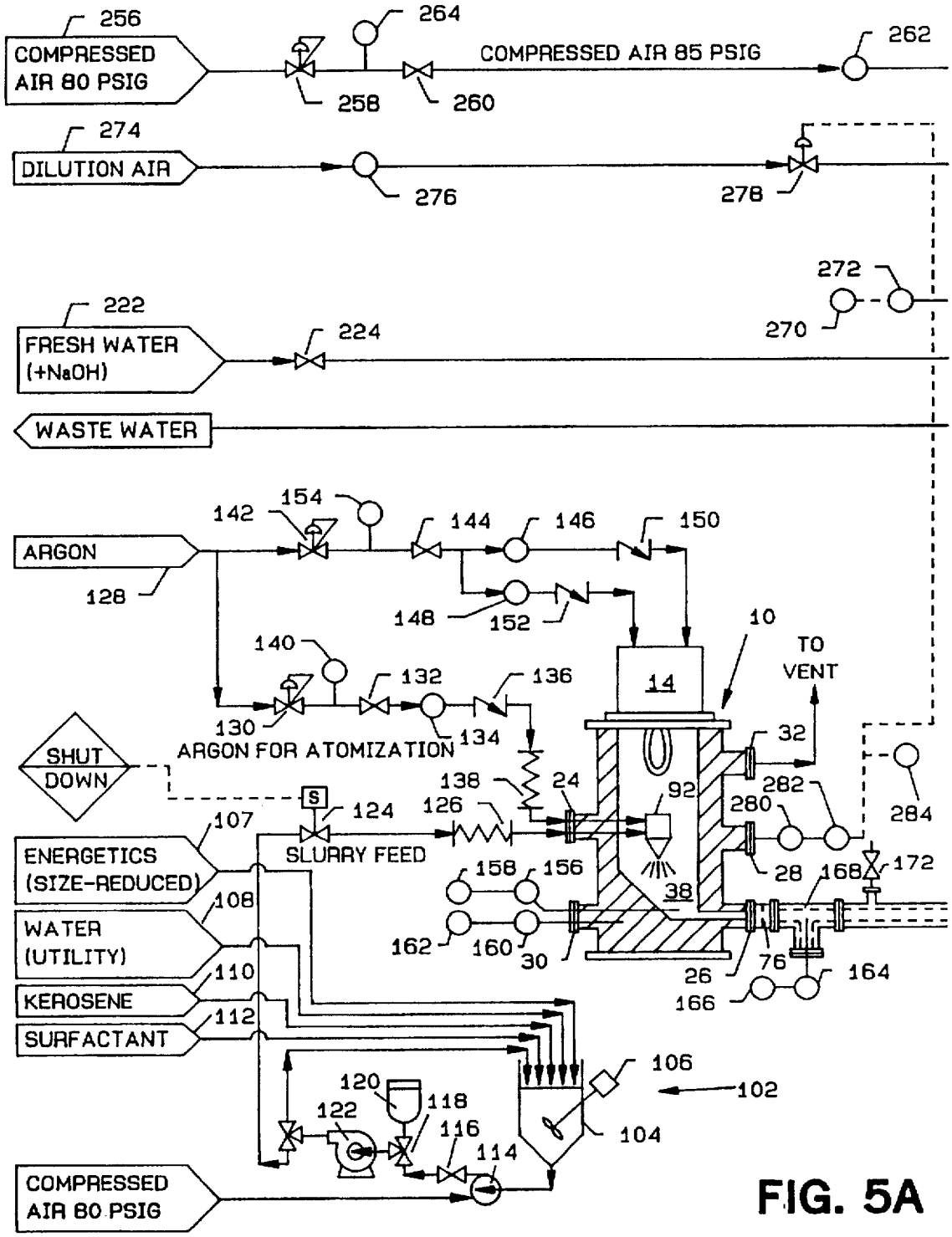
FIGS. 5A–5B illustrates a process and instrumentation diagram incorporating the primary and secondary PERC reactors.
Figure 5B:
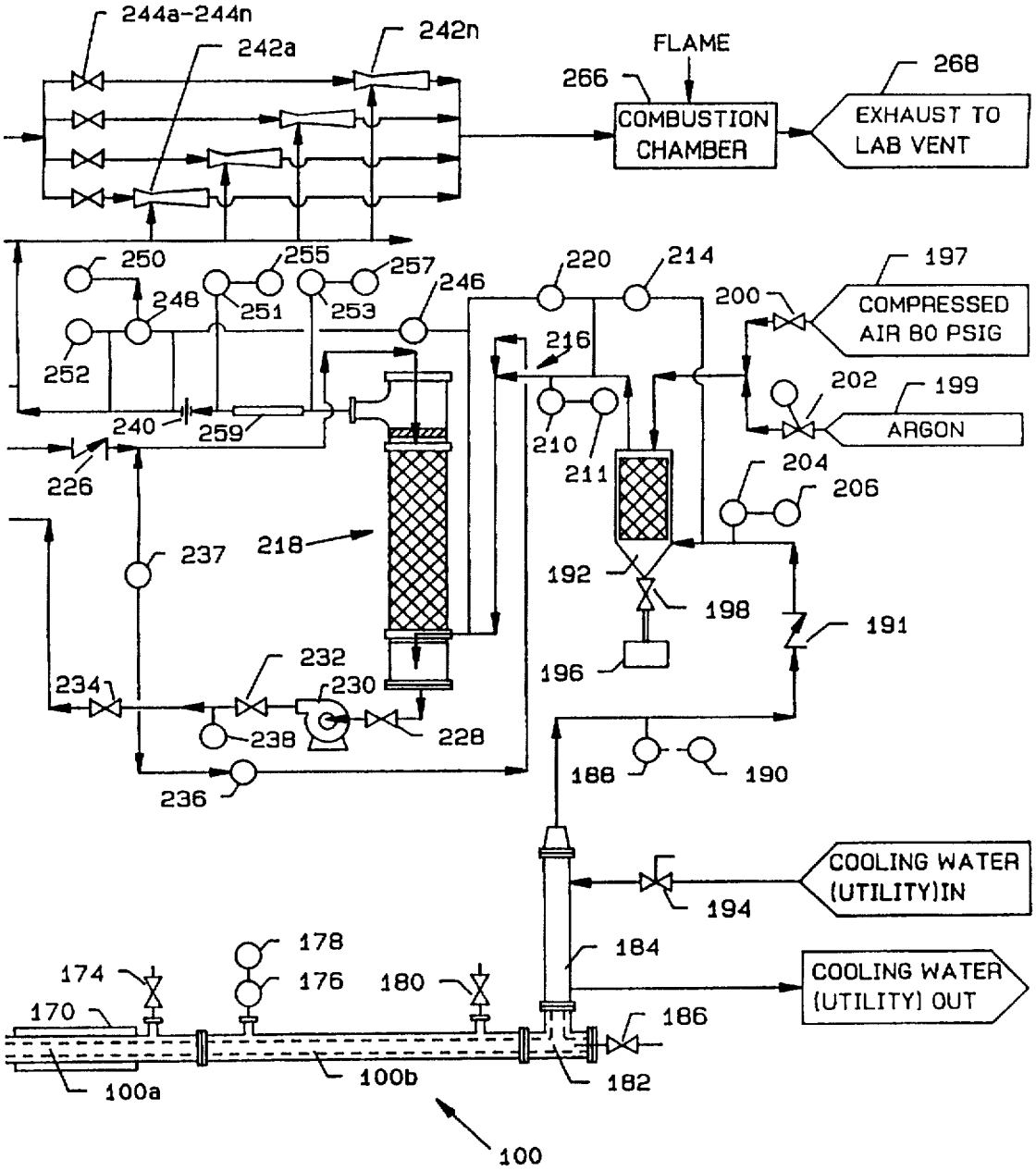

FIG. 4 illustrates the alignment of FIGS. 5A and 5B with respect to each other.

MODE OF OPERATION

FIGS. 5A and 5B illustrate a process and instrumentation diagram incorporating the primary PERC reactor 10 where all numerals correspond to those elements previously described. The primary PERC reactor 10 is incorporated into use as a primary reactor with a secondary PERC reactor 100 having secondary PERC reactor portions 100*a* and 100*b* in series.

A slurry preparation/feed system includes a slurry makeup/feed tank 104 having an agitator 106 to mix inputs of energetics 107, utility water 108, kerosene 110 and/or surfactant 112. Mixed slurry is fed through an air-driven homogenizer motor 114 through valves 116 and 118 to an emulsion start-up tank 120 and a progressive cavity metering pump 122. The slurry is routed through a flow safety valve 124, expansion joint 126 and the argon and slurry entry port 24 to the feed atomizing nozzle 92 for simultaneous dispersal with argon into the primary reactor chamber 38. Gases or liquid depending upon the material can be fed directly into the primary reactor chamber. Argon 128 or any other suitable gas under pressure is also sent to the feed atomizing nozzle 92 to aid in atomization of the slurry exiting the nozzle 92. This argon 128 flows through a pressure relief valve 130, valve 132, a flow indicating controller 134, check valve 136 and expansion joint 138. A pressure indicator 140 is also included in the argon atomizer supply line. Argon 128 is also provided for plasma injection into the plasma torch 14 through pressure relief valve 142, valve 144 and through a parallel feed system including flow indicating controllers 146, 148 and check valves 150 and 152. Other gases can be used after startup with argon gas such as oxygen, nitrogen or air. A pressure indicator 154 is also included. A high temperature plasma jet is generated by the induction coupled plasma torch 14 to convert atomized slurry to a gas in the primary reactor chamber 38. Gas is drawn off through the off-gas port 26 and mixing orifice 76 for further processing in the secondary reactor 100. Thermocouple probe 156 and temperature indicating recorder 158 and thermocouple probe 160 and temperature indicating recorder 162 connect through the thermocouple port 30 to sense reactor chamber temperature and core temperature respectively. A thermocouple probe 164 and temperature indicating recorder 166 connect to a tee member 168 aligned between the mixing orifice 76 and the secondary PERC reactor member 100*a*. A tube furnace 170 surrounds the first secondary PERC reactor portion 100*a*. Gas samples at the inlet and outlet of the secondary PERC reactor portion 100A are obtained through valves 172 and 174. A thermocouple probe 176 and a temperature indicating recorder 178 sense and record temperature at the inlet of the secondary PERC reactor portion 100*b*. A valve 180 provides for a gas sample at the outlet of the secondary PERC reactor portion 100*b*. A tee 182 at the outlet end of the secondary PERC reactor portion 100*b* provides for attachment of a water cooled heat exchanger 184 and for a gas sample valve 186. As previously provided for prior reactor stages a thermocouple 188 and a temperature indicating recorder 190 is provided along the heat exchanger 184 outlet line leading to a check valve 191 and to a sintered metal filter 192. A valve 194 controls the flow of utility cooling water into the heat exchanger 184. A fines collection pot 196 connects to the bottom of the sintered metal filter by a valve 198. Compressed air 197 and argon 199 are available for purging of the sintered metal filter by valves 200 and 202. A thermocouple probe 204 and a temperature indicating recorder 206 monitor the gas temperature entering the sintered metal filter 192. A pressure differential indicator 214 connects across the sintered metal filter 192. Cooled gas flows from the sintered metal filter through a check valve assembly 216 into an absorber tower 218. A pressure differential indicator 220 monitors the differential pressure between the sintered metal filter 192 and the absorber tower 218. Fresh water 222, in which caustic NaOH is dissolved, flows into the absorber tower 218 and is controlled by valve 224 and check valve 226. Waste water is drawn through valve 228 and recycle pump 230 to be discharged through valve 232 and valve 234 or to be recycled through the absorber tower 218. Flow meters 236 and 237 monitor fresh water flow through the absorber tower 218. Flow meter 238 monitors recycled water flow through the absorber tower 218. Gas is drawn from the top of the absorber tower 218 through an orifice 240 by action of a plurality of off-gas eductors 242a–242n controlled by valves 244a–244n. A pressure differential indicator 246 connects across the inlet and the top outlet of the absorber tower 218 and a pressure differential transmitter 248 and a pressure differential indicating recorder 250 connect across and to the orifice 240. Another pressure differential indicating recorder 252 aligns between the output of orifice 240 and atmosphere. Thermocouples 251 and 253 and temperature indicating recorders 255 and 257 monitor and record temperatures at each end of a heating tape 259 at the outlet of the absorber tower 218. Compressed air is supplied to the off-gas eductors 242a–242n through a pressure relief valve 258, valve 260 and flow indicator 262. A pressure indicator 264 is also included in the supply line. Off-gas is drawn through the off-gas eductors 242a–242n and routed to a waste gas combustion chamber 266 and a vent 268 for exhaust. Continuous monitoring of CO and $H_2$ are provided by an analysis indicator 270 and an analysis probe element 272. Dilution air 74 is also provided to the eductors 242a–242n through a flow indicating controller 276 and a pressure relief valve 278. A pressure differential transmitter 280 and a pressure indicating controller 282 align across the pressure transmitter and relief port 28 and the relief valve 278 in the dilution air supply 274. A pressure indicating recorder 284 also connects to the line extending from the pressure transmitter and relief port 28.

The following materials can be converted and/or destroyed to eliminate the hazardous character of the materials depending on each material and on a case-by-case basis for each material. Depending upon the waste such as a liquid, it may be necessary to mix the liquid with fuel oil or kersone. If the waste is gas, then an oxidizer such as oxygen or air may be added. If the waste is solid, then the waste would be ground up or pulverized and slurried with kersone or fuel oil and possibly use a surfactant, such as sorbitan mono laureate, to form a suitable emulsion. Below is a listing of suitable materials for conversion and/or destruction and is not to be construed as limiting of the present invention:

a. a solid rocket propellant;
b. a liquid rocket fuel;
c. a chemical agent;
d. a nerve gas;
e. all industrial waste;
f. a paint sludge;
g. a medical waste;
h. an aqueous liquid;
i. all organic liquid;
j. a low-level radioactive waste;
k. radioactive material;
l. energetic material; and,
m. any waste material.

At the out-end and depending upon the material, gases such as carbon dioxide, hydrogen, nitrogen, plasma gas or water vapor can exist, as well as possibly harmless ash and/or even entrained fly ash.

Various modifications can be made to the present invention without departing from the apparent scope hereof.

We claim:

1. A plasma energy recycle and conversion (PERC) reactor system for heating an atomized liquid, gas or slurry stream of waste to a high enough temperature for decomposition into an off gas plus a small amount of particulate comprising:

a. a plasma torch capable of sustaining a plasma (ions and atomic components) at a temperature greater than 6000° C.;
b. an inlet to said plasma torch to provide a plasma gas to said plasma torch;
c. a primary reactor chamber contiguously attached to said plasma torch wherein the decomposition of said waste stream occurs;
d. an entry port in said primary reactor chamber to provide access for said atomized stream of waste plus the atomization gas used to form said atomized stream;
e. an outlet port attached to said primary reactor chamber to provide for passage of said off gas and particulate out of said primary reactor;
f. an orifice restriction sealingly attached to said outlet port to provide a back-mixing in said primary reactor chamber to improve the conversion of off gas in said chamber; and,
g. wherein said atomized stream of waste is introduced into said primary reaction chamber in various directions to alter turbulent mixing and effect final quality of said off gas and comprises:
(1) radial introduction of said atomized stream;
(2) axial introduction of said atomized stream;
(3) tangential introduction of said atomized stream; and,
(4) co-current introduction of said atomized stream with the plasma direction.

2. A plasma energy recycle and conversion (PERC) reactor system for heating an atomized liquid, gas or slurry stream of waste to a high enough temperature for decomposition into an off gas plus a small amount of particulate comprising:

a. a plasma torch capable of sustaining a plasma (ions and atomic components) at a temperature greater than 6000° C.;
b. an inlet to said plasma torch to provide a plasma gas to said plasma torch;
c. a primary reactor chamber contiguously attached to said plasma torch wherein the decomposition of said waste stream occurs;
d. an entry port in said primary reactor chamber to provide access for said atomized stream of waste plus the atomization gas used to form said atomized stream;
e. an outlet port attached to said primary reactor chamber to provide for passage of said off gas and particulate out of said primary reactor;
f. an orifice restriction sealingly attached to said outlet port to provide a back-mixing in said primary reactor chamber to improve the conversion of off gas in said chamber;
g. a secondary tubular reactor sealingly attached to said orifice restriction wherein further decomposition of said off gas occurs; and,
h. wherein said secondary tubular reactor comprises a plug flow reactor with a length to diameter ratio.

3. A method of the plasma energy recycle and conversion (PERC) reactor system for heating an atomized liquid, gas or slurry stream of waste to a high enough temperature for decomposition into an off gas plus a small amount of particulate comprising the steps of:

a. producing a plasma with argon gas in a plasma torch;

b. atomizing a stream of waste using argon gas into a primary reactor chamber that contains said plasma;

c. decomposing said stream of waste into an off gas plus particulate;

d. mixing the contents of the primary reactor chamber;

e. allow passage of said off gas through a restriction orifice out of said primary reactor chamber; and, f. passing said off gas from said primary reactor into a secondary plug flow reactor for further decomposition.

4. A method of the plasma energy recycle and conversion (PERC) reactor system for heating an atomized liquid, gas or slurry stream of waste to a high enough temperature for decomposition into an off gas plus a small amount of particulate comprising the steps of:

a. producing a plasma in a plasma torch;

b. atomizing a stream of waste using a compressed gas into a primary reactor chamber that contains said plasma;

c. decomposing said stream of waste into an off gas plus particulate;

d. mixing the contents of the primary reactor chamber;

e. allow passage of said off gas through a restriction orifice out of said primary reactor chamber;

f. passing said off gas from said primary reactor into a secondary plug flow reactor for further decomposition; and, g. passing said off gas from said secondary reactor through a water cooled heat exchanger.

5. A method of the plasma energy recycle and conversion (PERC) reactor system for heating an atomized liquid, gas or slurry stream of waste to a high enough temperature for decomposition into an off gas plus a small amount of particulate comprising the steps of:

a. producing a plasma in a plasma torch;

b. atomizing a stream of waste using a compressed gas into a primary reactor chamber that contains said plasma;

c. decomposing said stream of waste into an off gas plus particulate;

d. mixing the contents of the primary reactor chamber;

e. allow passage of said off gas through a restriction orifice out of said primary reactor chamber;

f. passing said off gas from said primary reactor into a secondary plug flow reactor for further decomposition;

g. passing said off gas from said secondary reactor through a water cooled heat exchanger; and, h. passing said off gas through a filter to remove said particulate, an adsorber tower which converts HCL contained in said off gas to NaCL, using at least one eductor to draw the off gas out of said absorber tower, passing the off gas through a combustion chamber, and venting the remaining non-toxic off gas to the atmosphere.

6. A plasma energy recycle and conversion (PERC) reactor system for heating an atomized liquid, gas or slurry stream of waste to a high enough temperature for decomposition into an off gas plus a small amount of particulate comprising:

a. a plasma torch capable of sustaining a plasma (ions and atomic components) at a temperature greater than 6000° C.;

b. an inlet to said plasma torch to provide a plasma gas to said plasma torch;

c. a primary reactor chamber contiguously attached to said plasma torch wherein the decomposition of said waste stream occurs;

d. an entry port in said primary reactor chamber to provide access for said atomized stream of waste plus the atomization gas used to form said atomized stream;

e. an outlet port attached to said primary reactor chamber to provide for passage of said off gas and particulate out of said primary reactor;

f. an orifice restriction sealingly attached to said outlet port to provide a back-mixing in said primary reactor chamber to improve the conversion of off gas in said chamber;

g. a secondary tubular reactor sealingly attached to said orifice restriction wherein further decomposition of said off gas occurs;

h. a heat exchanger sealingly attached to said secondary tubular reactor;

i. a filter connected to said heat exchanger to remove said particulate;

j. an absorber tower connected to said filter;

k. at least one off gas eductor which draws off gas from said absorber tower; and, l. a combustion chamber connected to said gas eductor for receiving said off gas from said gas eductor for combustion and exhaust to a vent.

7. The system of claim 6, wherein said heat exchanger comprises a water cooled heat exchanger.

8. The system of claim 6, wherein said absorber tower serves to remove HCL from said off gas and convert it to NaCL.

9. The system of claim 6, wherein said eductors are supplied by compressed air to generate the draw of said off gas from said absorber tower.

* * * * *